US005540513A

United States Patent [19]

Wyant

[11] Patent Number: 5,540,513

[45] Date of Patent: Jul. 30, 1996

[54] FILE INDEXING SYSTEM

[75] Inventor: Jon R. Wyant, Spring Valley, Ohio

[73] Assignee: The Mead Corporation, Dayton, Ohio

[21] Appl. No.: 454,096

[22] Filed: May 30, 1995

Related U.S. Application Data

[63] Continuation of Ser. No. 187,606, Jan. 26, 1994, abandoned.

[51] Int. Cl.[6] ..... B42F 21/02

[52] U.S. Cl. ..... 402/79; 281/31; 281/38; 283/36

[58] Field of Search ..... 402/79, 75; 281/31, 281/38; 283/36–38, 42, 43

[56] References Cited

U.S. PATENT DOCUMENTS

| | | | |
|---|---|---|---|
| 231,394 | 8/1880 | Brown | 281/31 X |
| 303,346 | 8/1884 | Vernon | 281/31 |
| 1,048,577 | 12/1912 | Pardoe, Jr. | 40/359 |
| 1,053,670 | 2/1913 | Stillwell . | |
| 1,495,953 | 5/1924 | Dick | 281/38 X |
| 2,300,623 | 5/1941 | Hornung . | |
| 2,895,448 | 1/1955 | Haines . | |
| 3,561,147 | 2/1971 | Valencia . | |
| 3,680,969 | 8/1972 | Gorman | 402/75 X |
| 3,839,809 | 10/1974 | Casas et al. | 281/31 X |
| 4,184,699 | 1/1980 | Lowe, Jr. . | |
| 4,577,889 | 3/1986 | Schulz | 281/38 X |
| 4,583,764 | 4/1986 | Steffen | 281/31 |
| 4,602,734 | 7/1986 | Thompson | 229/1.5 R |
| 4,784,508 | 11/1988 | Shannon | 402/79 |
| 5,042,841 | 8/1991 | Friedman | 281/31 X |
| 5,186,565 | 2/1993 | Jack | 281/38 X |

FOREIGN PATENT DOCUMENTS

| | | | |
|---|---|---|---|
| 50592 | 4/1982 | European Pat. Off. | 281/31 |
| 905788 | 12/1945 | France | 281/31 |
| 1060841 | 7/1959 | Germany | 281/31 |
| 2900745 | 7/1980 | Germany | 281/31 |

*Primary Examiner*—Frances Han

*Attorney, Agent, or Firm*—Thompson Hine & Flory P.L.L.

[57] ABSTRACT

An indexing member comprising a card having a generally rectangular shape; a tab-yielding panel, along one edge of the card, folded inwardly and secured inwardly to the card; and at lease two inwardly folded tabs at spaced locations along the edge of the card, each tab being defined by a rupturable tear line adjacent the edge of the card and being retained in an inwardly folded portion by the rupturable tear line until the rupturable tear line is broken and each tab being foldable to outside the one edge of the card.

12 Claims, 3 Drawing Sheets

FILE INDEXING SYSTEM

This is a continuation of application Ser. No. 08/187,606, filed Jan. 26, 1994, now abandoned.

BACKGROUND OF THE INVENTION

This invention relates to a new and useful indexing system for file folders, index cards, binders, etc. in which file identification tabs can be folded outwardly at any of a number of selected positions along the edge of the folder, binder insert or card.

It is a common practice in the art to provide a tab member which extends from the edge of an index card or file folder at a select position in order to identify the card or file when it is placed in a file drawer, index card box or binder. Unfortunately, when all tabs are located at the same position, it becomes difficult to view the tabs and to locate the card or file in the filing system. A number of indexing systems have been described in the patent literature which respond to this problem.

Stillwell U.S. Pat. No. 1,053,670 discloses an index card having one movable tab for use in a filing system. The tab can be located at any one of a plurality of positions by being inserted into a corresponding aperture on the edge of the card.

Hornung U.S. Pat. No. 2,300,623 discloses a tab system for index cards in which an integral tongue, when folded, fits into a slot on the edge of the page to form a tab. The tab has at least one extension piece to keep it in place when the tongue is folded under the page to form the tab.

Lowe Jr., U.S. Pat. No. 4,184,699, teaches a page for a magazine or book having an integral tab which can be partially severed from the page and folded to extend outside the edge of the page. If the user desires to read the page, the tab can be folded back to its original position.

These patents fail to teach an indexing system for cards, binders or folders having a plurality of tabs which can be folded outside an edge of the card at any of a number of select positions. Once folded outside the edge of the card, the tab can be marked with identifying information. It has also become desirable to set up an indexing system in which the tabs are located at staggered intervals on the card.

SUMMARY OF THE INVENTION

This invention provides a card having a plurality of tabs which can be selectively folded outwardly of the edge of the card so that the tabs can be staggered when the cards are filed, thereby, facilitating tab viewing and card location. The multiple positioning of the tabs in accordance with this invention enables the user to determine the position of the card in the filing system and to extend one or any number of tabs when creating a filing system. In this manner, one card can be used at any location in the file and still be easily viewed.

The tabs are defined by rupturable tear lines extending inwardly on an inwardly folded tab-yielding panel of the card. The rupturable tear line holds the tab in a closed, or inwardly folded position, until such time as the tabs are used. In one embodiment, the card may also include a pocket for collecting papers. The card may further include apertures so that the card may be placed in a ring binder as an index card.

DETAILED DESCRIPTION

Figure 1:
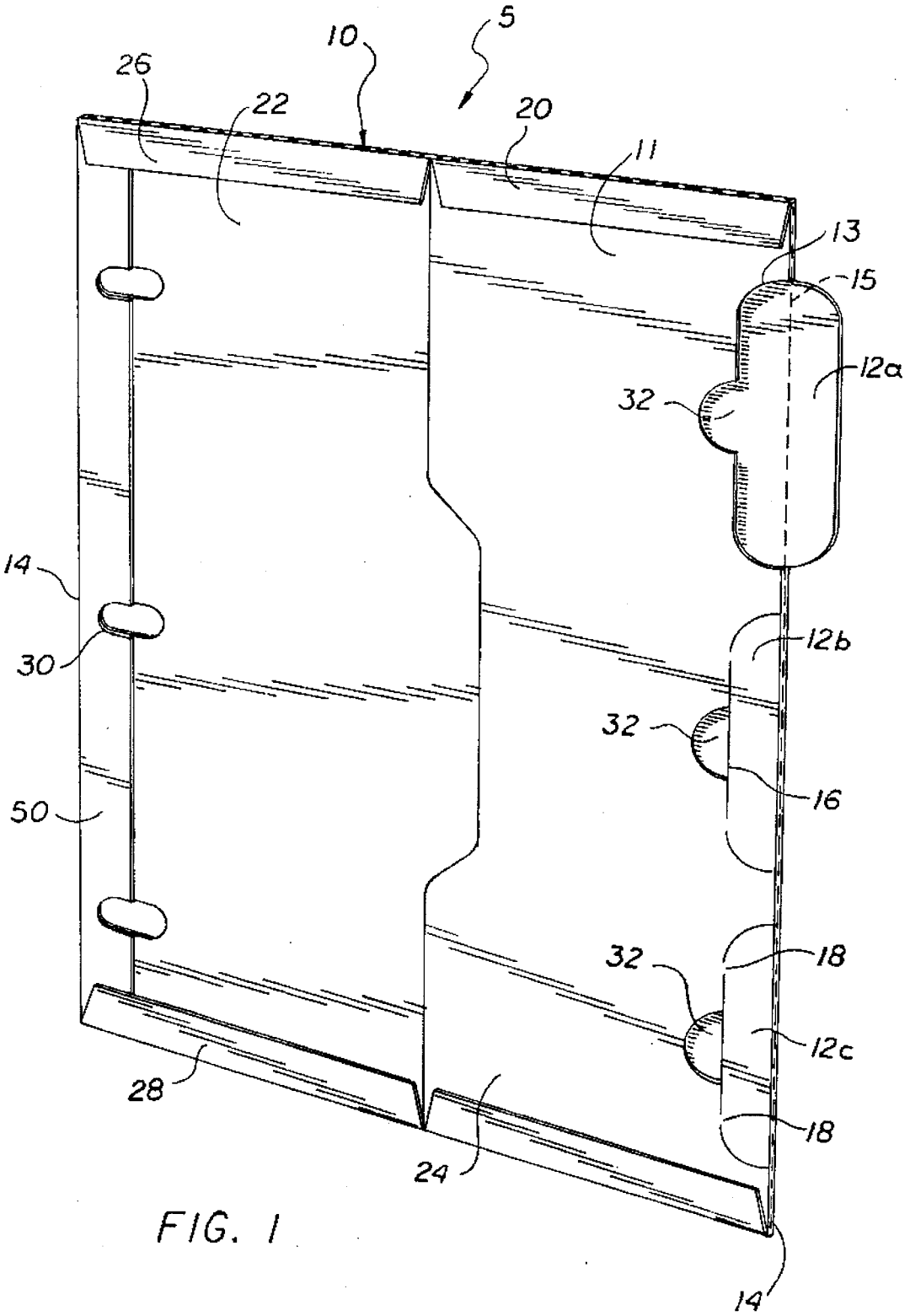
FIG. 1 presents a perspective view of an embodiment of this invention in which the tab system is used on an index card for use in a three ring binder.

An indexing member in accordance with the present invention is generally designated 5 in FIG. 1 and includes a card 10 having a plurality of tabs 12 at spaced locations along its edge 14. Tab 12A is in an outwardly folded position while tabs 12B and 12C are in an inwardly folded position.

The card 10 can have any dimensions, however, the card will typically have a size slightly larger than standard bond paper, legal paper or file cards. One skilled in the art will appreciate that the card 10 may have any convenient size or shape without deviating from the scope of the invention.

The indexing member 5 may be formed from any conventional stationery paper including card stock and paper stock. Preferably, card stock having a basis weight of 80 to 125 pounds per 3000 square feet formed from solid bleached sulphite pulp is used.

The indexing member 5 includes an inwardly folded tab-yielding panel 11. The tabs 12 are formed by cutting, scoring or perforating a rupturable tear line 16 in the tab-yielding panel 11 along a line 13 defining the inwardly folded periphery of the tab 12. The tabs 12 are outwardly foldable about the fold line 15 which is colinear with the edge 14 of the card 10. This allows the tabs 12 to be folded to a position outside the edge 14 of the card 10. The tabs 12 are held in a closed position by the rupturable tear line 16. Once the rupturable tear line 16 is ruptured, the tab 12 can be folded outward of the edge of the card 10 and marked with identifying indicia, if desired.

Figure 2:
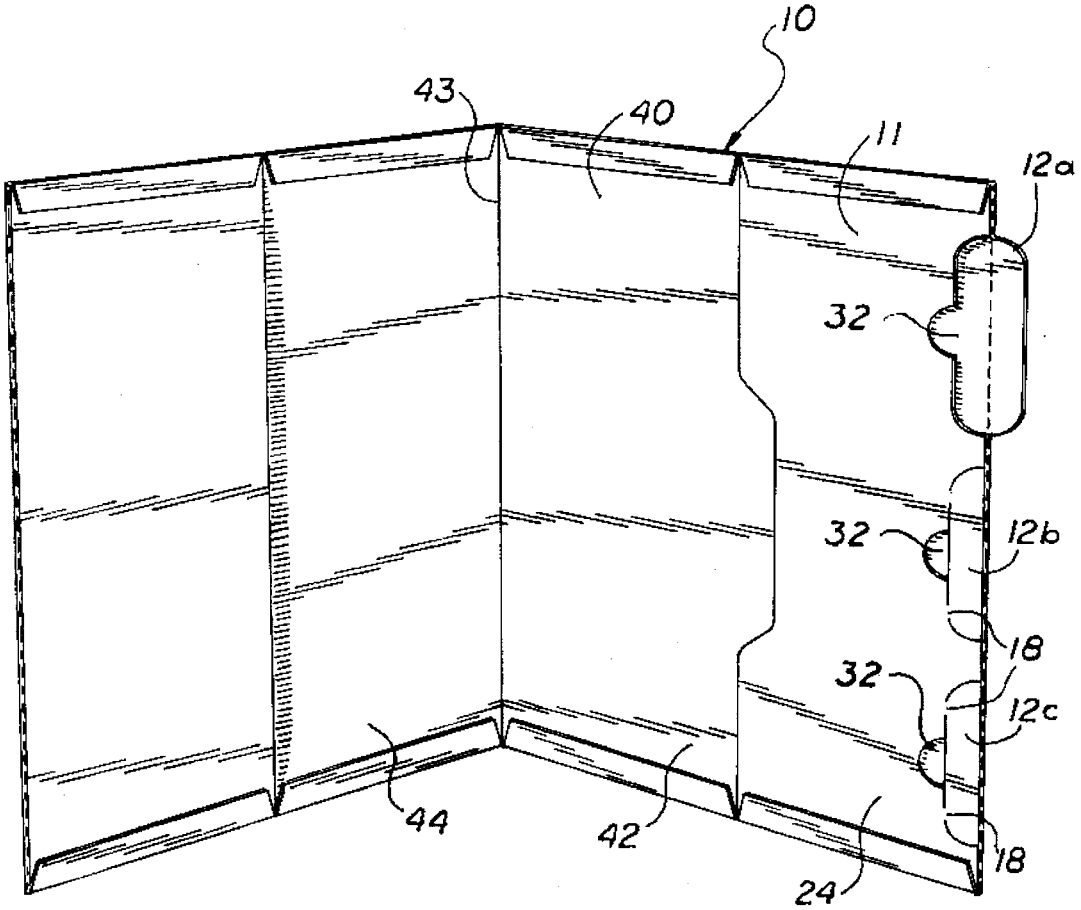
FIG. 2 presents a perspective view of one embodiment of this invention in which the tab system is used on a file folder.
Figure 3:
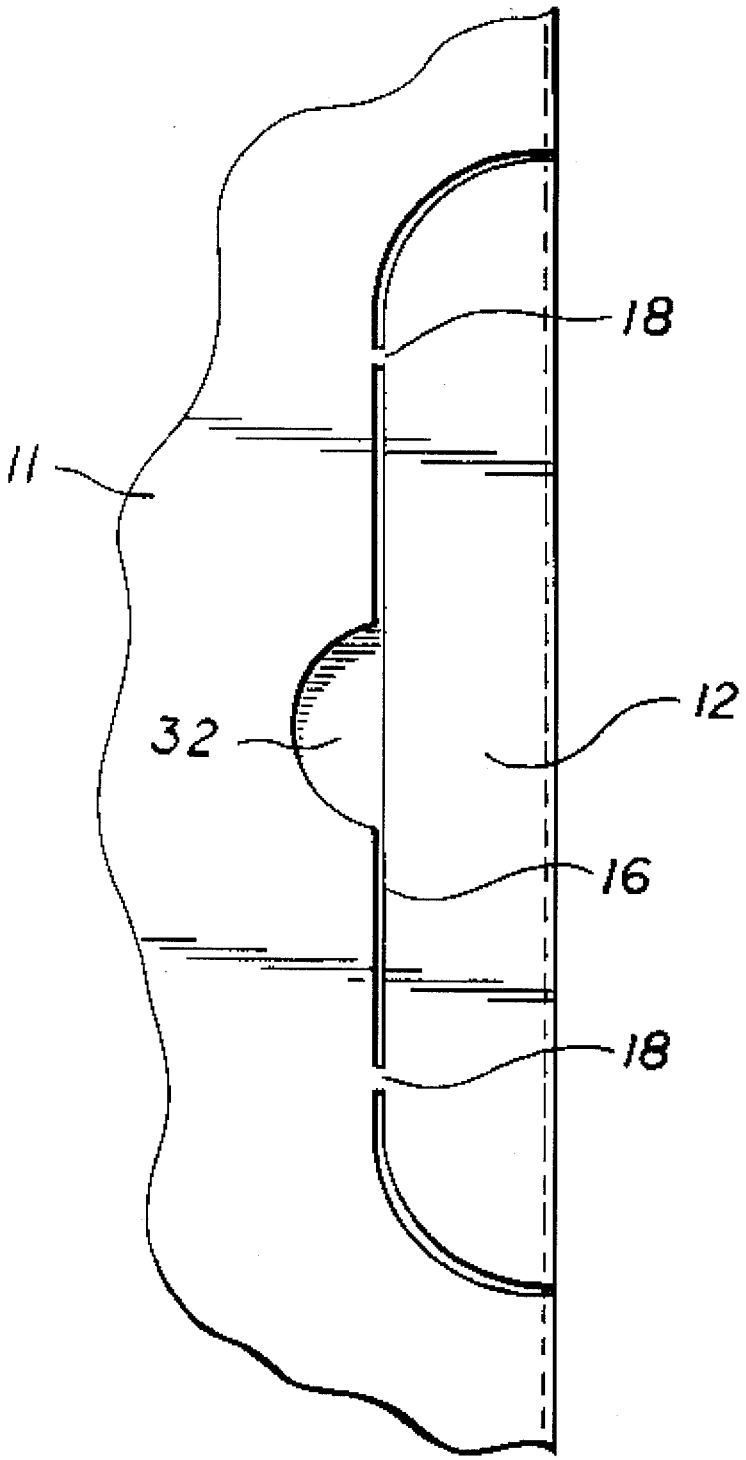
FIG. 3 presents an exploded view of a preferred embodiment of the invention in which the tabs are held in a closed position by nicks.

Although depicted in FIGS. 1–3 as having a relatively trapezoidal shape, one skilled in the art will appreciate that the tab 12 can have any desired configuration. The card 10 includes at least two tabs 12. In a preferred embodiment, the card 10 includes three tabs 12 located at the right, left and center positions, as indicated in both FIG. 1 and FIG. 2. While the user will normally fold out just one tab, this invention allows the user to fold out one, two or all of the tabs 12 at one time, depending on that person's indexing needs.

The tab-yielding panel 11 is folded inward and secured to the inside portion 22 of the card 10. Any convenient bonding method can be used to secure panel 11 to the card 10. For example, an adhesive can be applied along the inside margins of the tab-yielding panel 11. In an alternate embodiment of this invention, the tab-yielding panel 11 is folded inwardly to provide a pocket 24. In this embodiment, the tab-yielding panel 11 is secured to the body of the card 10. Top marginal panel 26 and bottom marginal panel 28 are folded inwardly and overlap the upper and lower portions, respectively, of the tab-yielding panel 11. The top marginal panel 26 and the bottom marginal panel 28 are secured to the panel 11 by an adhesive.

The rupturable tear line 16 may be formed by any of a variety of means commonly in use in the art to form such lines. In a preferred embodiment, the rupturable tear line 16 is a score line having at least one retaining nick 18. As shown in detail in FIG. 3, the nick 18 is formed by leaving an uncut paper bridge between the tab 12 and the inside of tab-yielding panel 11 along rupturable tear line 16. In a typical embodiment, the tab 12 is retained in a closed position by two nicks 18, one located on each side of a cutout 32. The cutout 32 facilitates access to the underside of the tab 12 by a fingernail or sharp object to break the tear line and open the tab 12. In an alternate embodiment of the invention, the rupturable tear line 16 can be a line of perforations.

The card 10 may be used in a variety of applications. The card 10 may include a plurality of apertures 30 such that the card 10 to be inserted into a ring binder. These apertures 30 may be punched adjacent to any edge of the card 10 except that edge 14 on which the tabs 12 are located. Usually, the apertures 30 will be located near the edge 14 opposite that on which the tabs 12 are located. On occasion, the apertures 30 may become ripped, thus preventing the card 10 from being secured in a ring binder. To prevent the apertures 30 from ripping, a side panel 50 of the card 10 may be folded inwardly to provide reinforcement for the apertures 30. As shown in FIG. 1, the apertures 30 are located opposite tabs 12 and reinforced by panel 50.

The card 10 may also be used as a file folder 40, as shown in FIG. 2. In this embodiment, the folder 40 includes a front leaf 42 and a rear leaf 44 which together fold along the fold line 43. The tabs 12 can be located on either leaf 42 or 44. The leaves 42 and 44 contain the papers and the tabs 12 indicate the contents of the folder 40. In a preferred embodiment, the file folder 40 includes at least one pocket 24 formed between the card 10 and the tab yielding panel 11.

In a preferred embodiment, the cutouts 32 are provided to facilitate opening the tabs 12. These cutouts 32 open on the rupturable tear line 16 such that the user can insert a finger, pencil, pen or other similar object into the cutout 32 to break the rupturable tear line 16 and open the tab 12. Usually, the cutouts 32 have a semicircular shape.

Having described the invention in detail and by reference to preferred embodiments thereof, it will be apparent that modifications and variations are possible without departing from the scope of the invention defined in the appended claims.

What is claimed is:

1. An indexing member consisting essentially of:

a card having a generally rectangular shape;

a tab-yielding panel, along one edge of the card, folded inwardly and secured inwardly to the card to form a pocket between the card and the tab-yielding panel; and at least two inwardly folded tabs at spaced locations along the edge of the card, each tab being defined by a rupturable tear line adjacent to the edge of the card and being retained in an inwardly folded position by the rupturable tear line until the rupturable tear line is broken and each tab being foldable to a position outside the edge of the card, the tab-yielding panel including cutouts adjacent to the rupturable tear line to facilitate rupturing the tear line and folding the tab outwardly.

2. The indexing member of claim 1 wherein the rupturable tear line is a line of perforations.

3. The indexing member of claim 1 wherein the indexing member further includes a plurality of apertures which allow the indexing member to be used in a ring binder or notebook.

4. The indexing member of claim 1 wherein the card is formed from card stock, having a basis weight of 80 to 125 pounds.

5. The indexing member of claim 1 wherein the indexing member is a file folder, having a front leaf and a rear leaf.

6. The indexing member of claim 5 wherein the indexing member includes three tabs.

7. The indexing member of claim 1 wherein the indexing member is an index card.

8. The indexing member of claim 7 wherein the indexing member has three tabs.

9. The indexing member of claim 1 wherein the rupturable tear line is a score line having at least one nick therein for retaining a tab in an inwardly folded position.

10. The indexing member of claim 9 wherein the cutouts have a semicircular shape.

11. The indexing member of claim 10 wherein the tear line includes at least one nick on each side of each cutout.

12. The indexing member of claim 11 wherein the indexing member has three tabs.

* * * * *

UNITED STATES PATENT AND TRADEMARK OFFICE

CERTIFICATE OF CORRECTION

PATENT NO. : 5,540,513

DATED : July 30, 1996

INVENTOR(S) : Jon R. Wyant

It is certified that error appears in the above-indentified patent and that said Letters Patent is hereby corrected as shown below:

In the Abstract, line 4, "lease" should be --least--

In the Abstract, line 7, "portion" should be --position--

In the Abstract, line 9, "foldable to outside" should be --foldable to a position outside--

Signed and Sealed this

Fifth Day of November, 1996

*Attest:*

*Attesting Officer*

BRUCE LEHMAN

*Commissioner of Patents and Trademarks*